United States Patent [19]

Nijhuis et al.

[11] Patent Number: 4,667,705

[45] Date of Patent: May 26, 1987

[54] WEFT CHANGE SYSTEM WITH A WEAVING MACHINE

[75] Inventors: Henri G. B. O. Nijhuis; Wilhelmus G. Toebes, both of Aalten, Netherlands

[73] Assignee: Gebruder Sulzer Aktiengesellschaft, Winterthur, Switzerland

[21] Appl. No.: 826,126

[22] Filed: Feb. 4, 1986

[30] Foreign Application Priority Data

Feb. 4, 1985 [NL] Netherlands ..... 8500301

[51] Int. Cl.[4] ..... D03D 47/33

[52] U.S. Cl. ..... 139/439; 139/453

[58] Field of Search ..... 139/171, 439, 453

[56] References Cited

U.S. PATENT DOCUMENTS

| | | | |
|---|---|---|---|
| 3,586,062 | 6/1971 | Hindle et al. | 139/171 |
| 4,406,312 | 9/1983 | Egbers et al. | 139/453 |

FOREIGN PATENT DOCUMENTS

| | | | |
|---|---|---|---|
| 716984 | 6/1968 | Belgium . | |
| 874724 | 7/1979 | Belgium | 139/453 |
| 3209376 | 9/1983 | Fed. Rep. of Germany . | |
| 1286421 | 1/1962 | France . | |
| 7100266 | 7/1972 | Netherlands . | |
| 418248 | 2/1967 | Switzerland . | |

*Primary Examiner*—Henry S. Jaudon

*Attorney, Agent, or Firm*—Michael N. Meller

[57] ABSTRACT

The invention relates to a weft change system for a weaving machine, the known complicated switching and release mechanism for the movement of a selection quadrant with weft thread holding devices being simplified by the tension-loadable or compression-loadable springs provided in the known mechanism being replaced by compressed air cylinders, in particular double-acting compressed air cylinders, which can be actuated by a computer-controlled programming device and whereby the complete complicated drive mechanism of the known systems can be dispensed with.

6 Claims, 5 Drawing Figures

WEFT CHANGE SYSTEM WITH A WEAVING MACHINE

Figure 1:
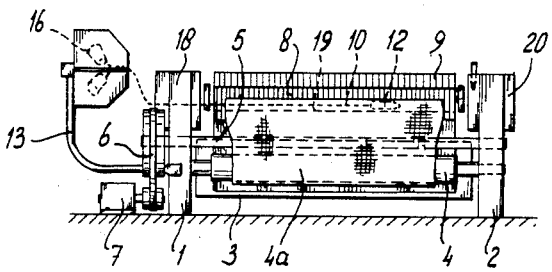

The invention relates to a weft change system in a weaving machine, consisting of a weft selection quadrant with at least two positions. The quadrant is rotatably mounted, is coupled at a distance from its axis of rotation to at least one operating member, in which a spring element is located and, is provided on one side with two or more weft thread holding devices and on the other side with a number of recesses equal to the number of weft thread holding devices. The recesses interact with a bolt member which is movable in and out of the recesses and is controlled by the main shaft of the machine with a frequency which is equal to the number of picks per unit time, while the operating member itself controls the quadrant as a function of signals which originate from a device provided with a program.

Such a weft change system is known, for example, from Swiss Patent Specification No. 475,390.

In weft change systems, it is important to be able to change type or color of a weft thread quickly during weaving. In the known weft change system, there is in the operating mechanism, for example, a member which is intended to adjust the weft selection quadrant so that the desired weft thread can be fed to an insertion member such as a shuttle. This member is a spring element which can be tensioned in one direction or the other and brings about an adjustment of the selection quadrant as soon as the bolt, which engages in a recess of the quadrant, releases the quadrant in time with the picks to be carried out and is controlled by a cam. These spring elements are coupled by means of pivotable connecting rods, toggle levers etc., to an eccentric disc which is located at the bottom of the machine on one of its sides and is driven by the main shaft. To be sure that the weft selection quadrant is turned through the desired travel quickly at the right time, a great pressure of about 20 bar is necessary in the spring element. This great load is disadvantageous for the bearings, and results in unsmooth running and rattling of the quadrant. This mechanical transmission consists furthermore of many parts which altogether represent quite a large mass. As soon as a selection quadrant with more than two, for example four, weft thread holding devices is used, the speed of the machine is greatly reduced, for example by 25%. If the cam is to be changed, this is complicated and requires a lot of time during which the machine is at a standstill.

In this known machine, the sequence of the actuation of the spring elements is also governed by a program which is made in a punched card and is scanned by pins.

If two different weft threads are being used, even then several programs are possible. For example, it is possible to insert one weft thread three times successively, then the other weft thread and then the first weft thread again three times. Regular changing is of course also possible, as is any variant in the number of weft yarns of one or other type to be inserted successively. If four or six different weft yarns are being used, the overall mechanism is more complicated. For example, when using four different weft threads, the selection quadrant may be arranged in four different positions, which takes place in this known machine with the aid of two spring elements which are mechanically controlled by the eccentric disc and act on a balance arm, the center of which is coupled to the quadrant. The fact that each spring element can be moved into two extreme positions means that four different positions of the center of the balance arm, and thus of the quadrant, are possible. This, however, gives the mechanism many pivot points, with associated play and wear.

The object of the invention is to create a weft change system which is substantially simpler, permits an unlimited number of variation possibilities in the woven design and is not disadvantageous with respect to the operating speed.

This object is achieved according to the invention in the first instance by the operating member or the operating members consisting of at least one compressed air cylinder with piston, one part of which (the cylinder) is fixed in the frame of the machine and the other part of which (the piston) is coupled to the quadrant and by this air cylinder or these cylinders being provided with a control slide valve, which is coupled to an electromagnetic operating member, which receives its operating pulses from the device with the program.

The fact that compresed air cylinders are used means that the entire operating mechanism, consisting of eccentric disc, rods and toggle levers etc., and spring elements, is dispensed with. Owing to the type of medium, the compressed air cylinders already provide the required elasticity by themselves. The compressed air cylinder or the compressed air cylinders can operate quickly; they are firmly fixed in the frame; there are hardly any bearings expected to operate under high loads.

If the weft change quadrant has space for two weft thread holding devices, then a single compressed air cylinder suffices.

If the quadrant has space for four weft thread holding devices, then instead of the known two-spring elements, which act on the balance arm, two compressed air cylinders may be used which can give the balance arm four different positions, which positions are known per se from the previously mentioned Swiss Patent Specification 475,390.

If six weft thread holding devices are used on the selection quadrant, various other solutions are conceivable.

For instance, it is conceivable that a second cylinder is added to one of the two cylinders intended for four weft thread holding devices, which second cylinder pushes this one cylinder back and fourth between two end positions in a guide which has been arranged in the frame.

It is also conceivable that one or more compressed air cylinders are used which are displaceable in stages or that the third cylinder is arranged in the operating linkage between the balance arm of the two other cylinders in the direction of the quadrant.

The programming device could be formed by a punched card system, the pins interacting with the holes of the punched card operating contacts for the control of the relevant electromagnetic operating members.

However, according to the invention it is preferred that the electromagnetic operating members receive added pulses from a programming device which is controlled by a computer and which is coupled to a pulse generator on the main shaft of the machine. In the known machine mentioned above, the punched card is pushed by a mechanism which is coupled to the main shaft. If the programming device controlled by the computer is used, it receives its signals in each case for the stage-by-stage tracing of the program by the pulse generator, which counts how many revolutions the main shaft has carried out.

Each compresed air cylinder could be a single-acting cylinder with restoring spring. However, according to the invention a double-acting compressed air cylinder or cylinders is preferred because they can operate quickly and more expediently and fatigue of a spring cannot occur.

In the case of a restoring spring, there is also the reduction in progressivity which occur during the working stroke of the spring while, with a compressed air control, the pressure and thus the force is constant over the entire length of the stroke.

The weft change system is extremely simplified by the invention. All previously mentioned misgivings are dispelled and the setting of the mechanism is likewise simplified.

Figure 3:
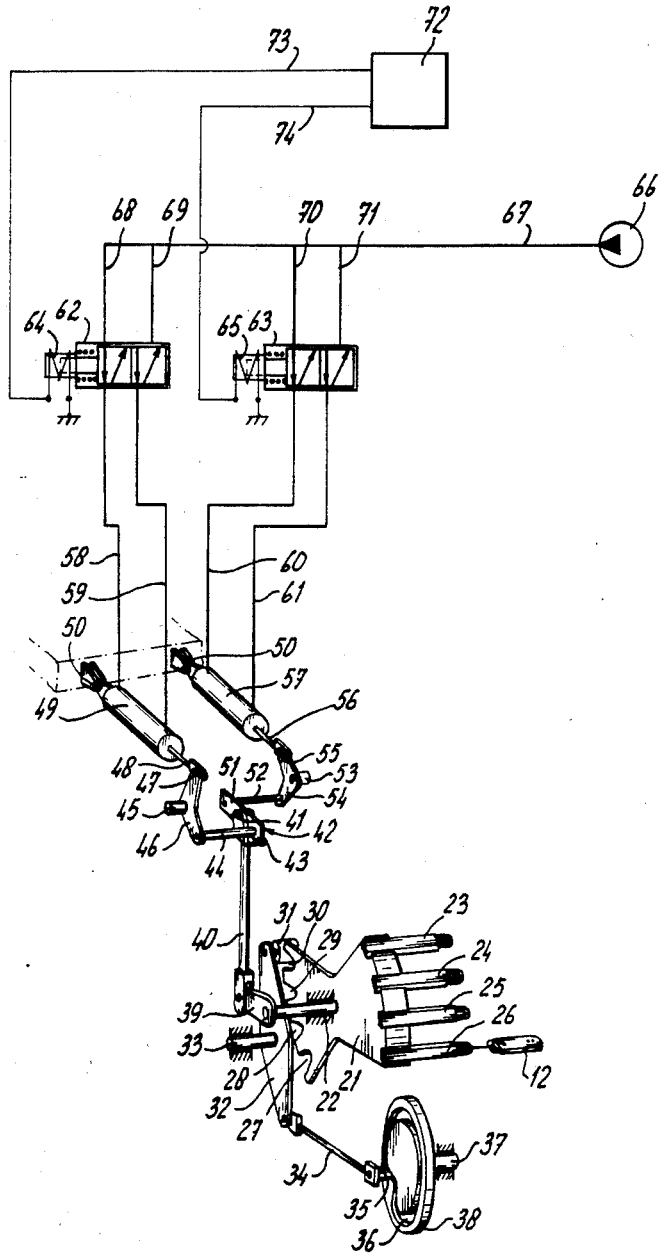
Figure 4:
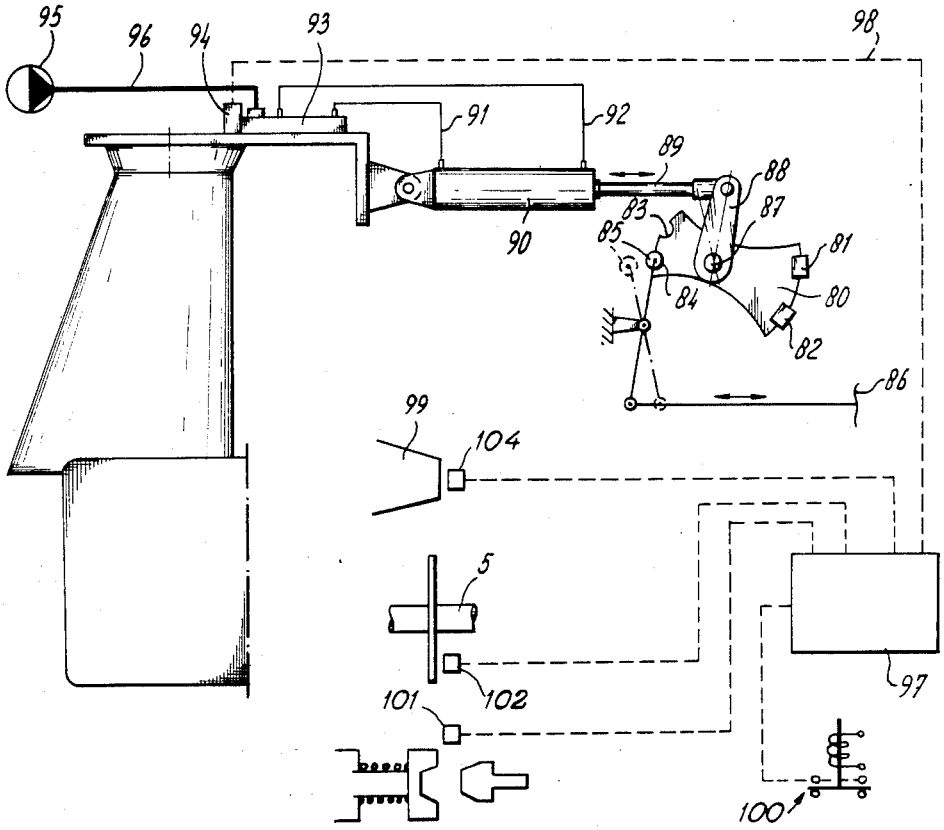
Figure 5:
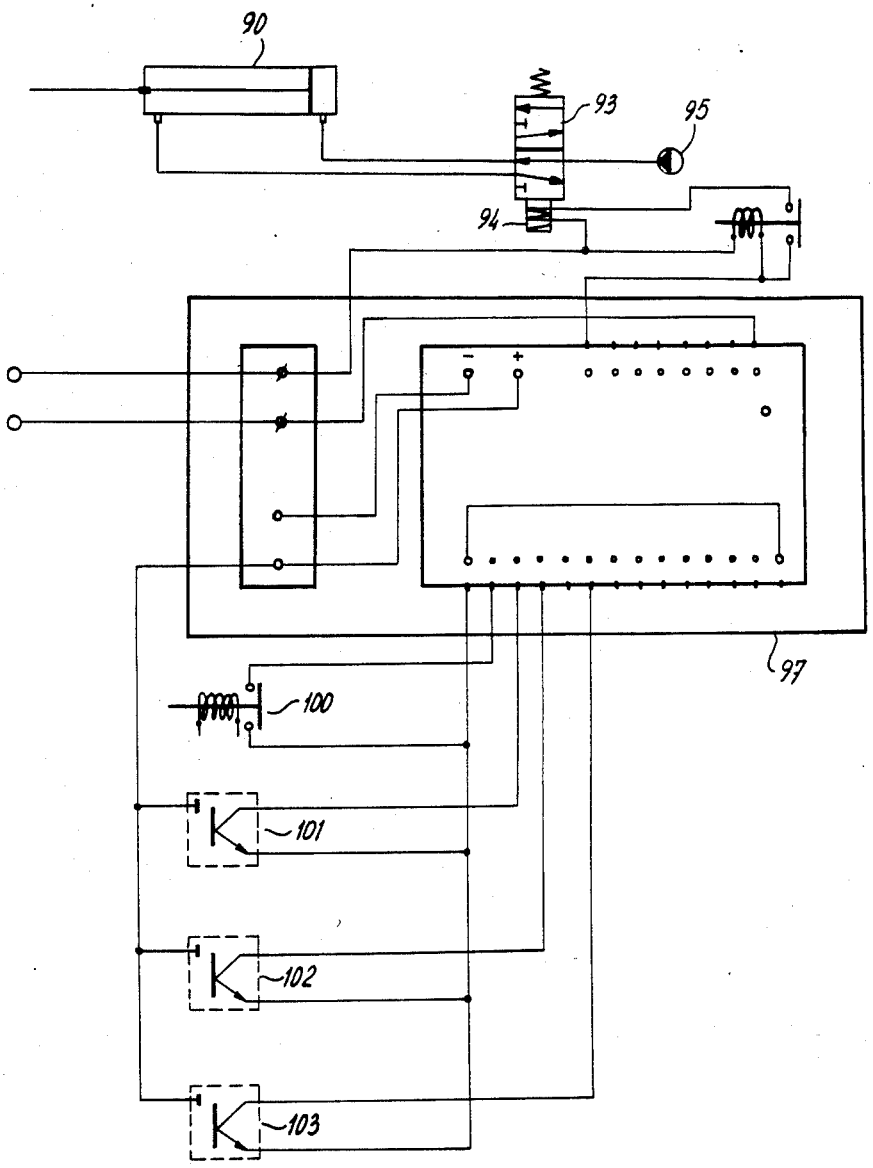

It is also noted that a weft change system in a weaving machine which operates without shuttles is known from German Patent specification No. 3,209,376. The selection quadrant is adjusted in this case with the aid of hydraulic cylinders. In the case of a selection quadrant with four positions, the piston rods of the two cylinders are displaceably arranged on pistons which are arranged in separate cylinder spaces and the piston rods of which are coupled to the frame and operate on the balance arm coupled to the quadrant. Eacy cylinder can thereby be brought into two positions and each piston rod coupled to the balance arm can likewise be brought into two positions, so that four positions are possible. These hydraulic cylinders are controlled by a program device. However, hydraulic control systems do not have the necessary elasticity and operate slower than pneumatic systems. dr The invention will now be explained in more detail with reference to the drawing, in which FIG. 1 is a diagrammatic front view which shows a weaving machine generally, FIG. 2 is the associated plan view, FIG. 3 shows the weft change system according to the invention in perspective representation for a system with four weft thread holding devices, FIG. 4 is a diagram for a weft change system with two weft thread holding devices, FIG. 5 is the associated electrical circuit diagram.

Figure 2:
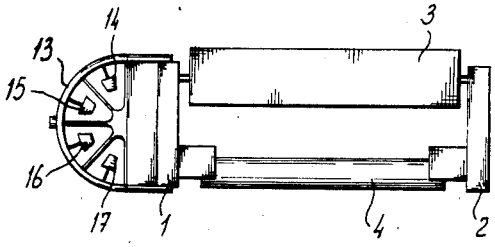

The weaving machine shown in FIGS. 1 and 2 has a frame with two sides 1 and 2, between which the warp beam 3 and the cloth beam 4 with the wound-on cloth 4*a* are located.

The machine has a main drive shaft 5, which is mounted in the side parts 1 and 2. Located on this main shaft 5 is a coupling 6 with brake, while numeral 7 denotes an electrical drive motor.

FIG. 1 shows, furthermore, the reed 8 for beating up a weft thread 10, while the shafts have been indicated by numberal 9.

The shuttle is indicated by numeral 12 in its path through the shed with the accompanying weft thread 10.

The machine has at the side of the side part 1 a frame 13, which carries several supply coils 14, 15, 16 and 17, which each contain a different type of yarn or a yarn of a different color.

In the box 18 there is the mechanism for the picking of a shuttle 12, which can move thereby over a shuttle guide 19.

Numeral 20 indicates the device for catching the shuttle.

Located between the side 1 and the frame 13 is the weft change system, not shown in FIGS. 1 and 2, for four different weft threads, which will be explained further below with reference to FIG. 3. This mechanism consists of a selection 21, which has been fixed firmly onto a shaft 22. This selection quadrant carries four weft thread holding devices 23, 24, 25 and 26, which can feed a thread to a shuttle 12 when they have been arranged in the path of the shuttle, as shown for the weft thread holding device 26.

The selection quadrant has, on the side which lies opposite the weft thread holding devices, four recesses 27, 28, 29 and 30. The selection quadrant is held by bolt 31 in a certain position, which bolt has been fixed to a lever 32 which is rotatably mounted onto a pin 33. The lever 32 is coupled via the rod 34 and a guide pin 35, to a cam 38 which is mounted on the shaft 37. The guide pin 35 engages curved groove 36 formed in cam 38.

With every revolution of this cam, the bolt 31 is briefly lifted out of a recess 27, 28, 29 or 30 so that the selection quadrant 21 has the opportunity of performing its travel.

Located on the shaft 22 of the selection quadrant is a lever 39 which is pivotally connected by means of a rod 40 to the center 41 of a balance arm 42. This balance arm is coupled at the end 43 by a pin 44 to a toggle lever 46 rotatably mounted on pin 45, the end 47 of which toggle lever is pivotably coupled to the piston rod 48 of a double-acting compressed air cylinder 49. This compressed air cylinder is fitted in the frame, which has been diagrammatically indicated by the pivot 50.

The other end 51 of the balance arm is coupled by means of the pin 52 to a toggle lever 54 pivotably mounted on pin 53, the upwardly directed leg 55 of which toggle lever is pivotably connected to the piton rod 56 of a double-acting compressed air cylinder 57, which is likewise pivotably connected to the frame by a pivot 50.

This mechanism is known from the previously mentioned Swiss Patent Specification No. 475,390, apart from the compressed air cylinder. In FIG. 3 of this Swiss Patent Specification, spring elements act on the toggle levers, which spring elements can be biased in tension and compression with the aid of a lever system which is controlled by a cam provided at the bottom in the machine frame.

If the spring element is under tensile load, the toggle lever connected thereto assumes a different position than with compression. Each toggle lever thus has two different positions and, because they both act on the balance arm 43, its center can be given four different positions which, by means of the described transmission mechanism 39, 40, can likewise give move the selection quadrant to four different positions.

The spring element can bring about this change in this position as soon as the bolt 31 has breifly released the selection quadrant.

The two compressed air cylinders 49 and 57 are connected via lines 58, 59 and 60, 61, respectively, to control slide valves 62 and 63, respectively, which can be moved out of the position shown into the outer extreme position with the aid of the magnet coils 64 and 65, respectively. Supply with compressed air takes place from a source 66 via diagrammatically indicated supply lines 67, 68, 69, 70 and 71.

The magnet coils 64 and 65 receive control pulses from a computer-controlled programming device 72 via electrical connections 73 and 74, respectively.

Because the slide valves can be moved into two positions, the pistons in the cylinders 49 and 57 can likewise be moved into two positions so that the balance arm 43 can be given four different positions in a way which is comparable with positions as have already been shown in the diagram of FIG. 6 of the previously mentioned Swiss Patent Specification No. 475,390.

The electromagnetic slide valves and the double-acting compressed air cylinders are parts which are normally commercially available.

In the mechansim depicted in FIG. 3, a large number of simplification have been introduced and further developed on the basis of the known mechanism, by replacing the spring elements with absorbers by double-acting compressed air cylinders, and by completely omitting the entire drive mechanism which runs from the cam through to the spring elements and subjects these to tensile or compressive stress.

The effect will now be further explained with reference to FIGS. 4 and 5, which show diagrams for a weft change system with only two weft thread holding devices.

The selection quadrant 80 shown in FIG. 4 has two weft thread holding devices 81 and 82 and, of course, two recesses 83 and 84. The bolt 85 can release the selection quadrant 80 with the aid of the diagrammatically indicated cam 86.

The selection quadrant 80 is firmly fixed on a shaft 87, which carries a lever 88, which is pivotably connected to the piston rod 89 of a single double-acting compressed air cylinder 90. The compressed air supply lines of the cylinder have been indicated by 91 and 92 and these are connected to a slide valve 93, which can be moved by an electromagnetic coil 94 to one of its working positions, in the same way as was explained with reference to FIG. 3. Compressed air supply 96 is supplied from a source 95.

The computer-controlled programming device dicated by 97 and can be a commercially available unit which is suitable for the control of various devices, for example a "Omron Sysmac S-6 Program Logic Control", as distributed by Messrs. Carlo Gavazzi Omron B.V., Amsterdam.

If this device 97 sends a pulse to the electromagnet 94 via the electrical connection 98, the slide valve 93 is brought into a position which reverses the compressed air supply at the point of the double-acting cylinder, so that the latter can carry out a stroke as soon as the bolt 85 has released the selection quadrant.

The pulse signal to the electromagnetic coil 94 is not sent by the device 97 until the sensor 102 interacting with the main shaft 5 has detected a predetermined number of revolutions of the main shaft. This sensor 102 consists, for example, of a proximity switch which is likewise commercially available as "Omrom Proximity Switch Type TL-X-(F)", distributed by Omrom Tateisi Electronics Co. te Kiohsi.

It is possible that the machine will stops on account of a wire breakage and this generally takes place at a moment at which the sensor 102 has already sent a number of pulses to the control device 97. If, after repair of the wire breakage, the machine were to be put in operation again, there would be a mistake in the fabric. Thus, in the event of wire breakage, the machine must be turned back manually. To ensure then that the already counted pulses are deducted, a subtracting sensor 101 is provided which comes into action when a lever, to which the subtracting sensor 101 has been fixed, is operated which lever makes it possible to rest the machine manually.

If the machine is at a standstill, the contact 100 is open (see FIG. 5). The pulses of the subtracting sensor 101 can, however, be passed to the control device 97 and take care of the subtraction of the pulses already passed on, so that once the wire breakage has been repaired, the weaving sequence is correct again.

The device also has a locking sensor 104. This locking sensor is a safeguard. During manual turning of the main shaft, incorrect pulses may likewise be given, and this is also possible if a metal part is accidentally brushed along the sensor 102.

The contact 100 shown in FIG. 5 is externally connected to the take-over contact of the magnetic switch. This contact 100 is closed when the motor turns and starts the control device 97 for adding the pulses of the sensor 102. For the complete mechanism to be brought into action, a start switch has to be operated, indicated by 99, whereby the sensor 104 of the control device 97 gives the signal that the complete mechanism can and may operate.

We claim:

1. In a weft change system in a weaving machine, consisting of a weft selection quadrant with at least two positions, which quadrant is rotatably mounted, is coupled at a distance from its axis of rotation to a first operating member, in which an elastic means is located, and is provided on one side with two or more weft thread holding devices and on the other side with a number of receses equal to the number of weft thread holding devices, which recesses interact with a locking member which is movable in and out of the recesses and is controlled by the main shaft of the machine with a frequency which is equal to the number of picks per unit time, while said first operating member controls said quadrant as a function of signal which originate from a device provided with a program, the improvement wherein said first operating member comprises a compressed air cylinder with piston, the cylinder of which is fixed in the frame of the machine and the piston of which is coupled to the quadrant and wherein said air cylinder is connected to a control slide valve, said valve being coupled to an electromagnetic operating member which receives its operating pulses from the device with the program.

2. The weft change system according to claim 1, further consisting of a second operating member in which an elastic means is located, said first and second operating members being coupled to the extreme ends of a balance arm, the center of which is coupled to said quadrant, wherein said second operating member comprises a compressed air cylinder connected to a control slide valve coupled to an electromagnetic operating member.

3. The weft change system according to claim 1, wherein the electromagnetic operating member receives the pulses from a computer-controlled programming device which is coupled to a pulse generator on the main shaft of the machine.

4. The weft change system according to claim 1, wherein said first operating member is a double-acting compressed air cylinder.

5. The weft change system according to claim 2, wherein the electromagnetic operating members receive the pulses from a computer-controlled programming device which is coupled to a pulse generator on the main shaft of the machine.

6. The weft change system according to claim 2, wherein said first and second operating members are double-acting compressed air cylinders.

* * * * *